US006653605B2

(12) United States Patent
Kneuer

(10) Patent No.: US 6,653,605 B2
(45) Date of Patent: Nov. 25, 2003

(54) INFANT INCUBATORS AND INFANT WARMERS WITH SINGLE PATIENT AND TWIN PATIENT CONTROL

(75) Inventor: Harald Alexander Kneuer, Spring House, PA (US)

(73) Assignee: Dräger Medical AG & Co. KGaA, Lübeck (DE)

( * ) Notice: Subject to any disclaimer, the term of this patent is extended or adjusted under 35 U.S.C. 154(b) by 51 days.

(21) Appl. No.: 10/124,519

(22) Filed: Apr. 17, 2002

(65) Prior Publication Data

US 2003/0197003 A1 Oct. 23, 2003

(51) Int. Cl.[7] ..... H05B 1/02; A61G 11/00

(52) U.S. Cl. ..... 219/494; 392/418; 392/382; 600/22; 219/217

(58) Field of Search ..... 219/494, 217; 392/418, 380, 379, 382; 600/22; 607/96

(56) References Cited

U.S. PATENT DOCUMENTS

| | | | | | |
|---|---|---|---|---|---|
| 3,338,233 | A | * | 8/1967 | Grosholz et al. | 392/382 |
| 3,920,000 | A | * | 11/1975 | Atherton et al. | 600/22 |
| 4,034,740 | A | * | 7/1977 | Atherton et al. | 600/22 |
| 4,162,393 | A | * | 7/1979 | Balboni | 219/217 |
| 4,969,459 | A | * | 11/1990 | Gusakov | 607/100 |
| 5,385,529 | A | | 1/1995 | Koch | |
| 5,415,618 | A | * | 5/1995 | Koch | 600/22 |
| 5,944,651 | A | | 8/1999 | Koch | |
| 6,048,304 | A | | 4/2000 | Koch | |
| 6,443,885 | B1 | * | 9/2002 | Schuler | 600/22 |
| 2002/0147381 | A1 | * | 10/2002 | Kolarovic | 600/22 |

FOREIGN PATENT DOCUMENTS

| | | |
|---|---|---|
| DE | 199 60 989 | 7/2001 |
| GB | 1370662 | * 10/1974 |

* cited by examiner

*Primary Examiner*—John A. Jeffery
(74) *Attorney, Agent, or Firm*—McGlew and Tuttle, P.C.

(57) ABSTRACT

A system for controlling the heating and temperature monitoring of infant incubators and infant warmers is provided with an incubator or infant warmer space, a heater for heating the space as well as a first temperature sensor and a second temperature sensor. An input device for input of one or more control setting works in conjunction with a control device connected to the heater and to the first temperature sensor and the second temperature sensor. The control device forms a control temperature from an input first skin temperature target control setting for a first patient and an input of a second skin temperature target control setting for a second patient and further patients if present and controls the heater based on a difference between the control temperature and an actual temperature value based on a first actual temperature sensed by the first temperature sensor and a second actual temperature sensed by the second temperature sensor.

19 Claims, 6 Drawing Sheets

34

| | SET | | ACTUAL |
|---|---|---|---|
| $T_{skin1}$ | 36.5°C | $T_{skin1}$ | 36.7°C |
| $T_{skin2}$ | 37.0°C | $T_{skin2}$ | 36.9°C |
| $T_{da1}$ | 0.5°C | $T_{da1}$ | 0.5°C |
| $T_{da2}$ | 0.5°C | $T_{da2}$ | 0.25°C |
| $T_{control}$ | 36.75°C | $T_{control}$ | 36.8°C |
| $T_{\Delta control}$ | 1.0°C | $T_{\Delta control}$ | 0.5°C |

INFANT INCUBATORS AND INFANT WARMERS WITH SINGLE PATIENT AND TWIN PATIENT CONTROL

FIELD OF THE INVENTION

The invention relates generally to infant care units such as incubators and infant warmers and relates more particularly to a system, method and apparatus for monitoring the status of an infant being warmed or treated and controlling operation of the incubator or infant warmer.

BACKGROUND OF THE INVENTION

Infant incubators and infant warmers are used to provide heat support to premature infants who cannot maintain their own body temperature. Temperature control is provided by various different processes. In many incubators and infant warmers the temperature control process is selectable by the user.

Both the control and monitoring of infant warmers and incubators can be provided using various different sensing and control systems. So-called manual mode may be used wherein information is provided as to the temperature in the incubator or the infant space of the infant warmer and the heater output may be set manually. This type of system is an open loop system. Typically some type of alarm is provided to indicate heater power termination if this is not confirmed by the caregiver. Monitoring and control referred to as air control is often used where the user sets the desired air temperature of the incubator or baby warmer space. The system provides for measurement of the actual temperature inside the infant's compartment or infant space and regulates a heater to supply adequate heat to reach the desired air temperature. An air temperature deviation alarm can be selected by the user, for example between 1.5 and 2.5° C. or some similar setting.

Skin control of an infant warmer or incubator is based on a desired skin temperature for the patient and based on a sensing of the actual skin temperature of the patient. A skin temperature sensor is attached to the infant (for example at the abdomen or lower back or head). The incubator or warmer measures the infant's skin temperature via the skin sensor and regulates a heater to supply adequate heat to reach the desired skin temperature. A skin temperature deviation alarm can be selected for example from 0.3 to 1.0° C. An alarm can be triggered if the actual skin temperature falls outside the alarm limits. So called skin control monitoring and control has advantages and is considered a preferred mode of operation for incubators and infant warmers.

U.S. Pat. No. 6,048,304 discloses a process for controlling the operating parameters of an incubator. The process uses skin control concepts and in particular provides multiple sensors such as a first sensor for measuring the infant patients core temperature (such as for measuring the skin temperature at the head or abdomen) and a peripheral skin temperature sensor. Additionally an air temperature sensor measures the actual air temperature in the incubator. The process sets the air temperature in the incubator as a function of both the core temperature and the peripheral temperature of the infant patient. The actual core temperature and peripheral temperature are calculated based on sensed values. The use of both a sensing to determine the core temperature and peripheral temperature is proven to be useful. It has been noted that undercooling can be recognized in the case of highly premature or full-term newborn babies from an intense cooling of the periphery, while the core of the body is still in the normal range. This is based on the body's attempt to maintain the core temperature by throttling the blood flow to the periphery, thus reducing the heat loss to the environment at the periphery. An increasing fever can be recognized from a decrease in the peripheral temperature with rising core temperature of the body. The body has centralized the blood flow to the core in this case in order to heat to a higher temperature, and it throttles the blood flow to the periphery in order to save heat and to use it to heat the central organs. A subsiding fever can be recognized from the high core temperature of the body with a simultaneously high peripheral temperature. The body uses the large surface of the periphery to cool the core of the body by a corresponding release of heat. The process of U.S. Pat. No. 6,048,304 provides a solution of the problem that temperatures measured at the patient are measured at the skin surface and are therefore distorted by external effects such as air flows. This determination of core and peripheral temperatures based on calculations using sensed values allows operating conditions of the incubator to be set correctly. U.S. Pat. No. 6,048,304 is hereby incorporated by reference.

Recently clinical studies have shown that co-bedding of premature twins in the same warming device can be beneficial to the development of the infants. However, currently available warming devices do not provide the same control methods as discussed above for twins. The problem relates to the fact that two patients are occupying the space. Since one of the twins would have to be selected to be the "supplier" of the skin temperature measured via the skin temperature sensor, this could result in a problem since the heat requirements of the two infants could be different. If skin temperature information from only one infant is used, resulting in one infant being comfortable, the other infant could be too warm or too cold.

As such, infant care devices (incubators/warmers) used for co-bedding of premature twins are operated in air or manual mode respectively, thereby avoiding the selection of a "control infant." The user has to manually check both infant temperatures and then adjust the air temperature setting to a value agreeable for both infants. Even if sensors are connected to each of the infants for taking skin temperature readings, hence avoiding the manual taking of temperatures, it is still necessary to operate the device in air/manual mode with the air temperature set and adjusted by the caregiver at regular intervals.

This has the disadvantages of requiring a great deal of time so as to be time intensive for the caregiver. The result may be inconsistent and may depend on the individual caregiver's attention and thoroughness. Frequent interruptions of the infant's create "down time," since the incubator needs to be opened and the infants will be manipulated during the process of taking the temperature of each infant.

SUMMARY OF THE INVENTION

The primary object of the invention is to allow the user to operate the incubator in substantially the same manner regardless of the number of infant occupants—single or double, triple, quadruple, etc. and/or to provide a monitoring and control system and method than monitors and controls based on the patient's temperature regardless of the number of occupants—single or double, triple, quadruple, etc.

According to the invention, a system for controlling the heating and temperature monitoring of infant incubators and infant warmers is provided with an incubator or infant warmer space, a heater for heating the space as well as a first temperature sensor and a second temperature sensor. An input device for input of one or more control setting works in conjunction with a control device connected to the heater and to the first temperature sensor and the second temperature sensor. The control device forms a control temperature from an input first skin temperature target control setting for a first patient and an input of a second skin temperature target control setting for a second patient and further patients if present and controls the heater based on a difference between the control temperature and an actual temperature value based on a first actual temperature sensed by the first temperature sensor and a second actual temperature sensed by the second temperature sensor.

The control device preferably calculates the control temperature as the average of the input first skin temperature target for the first patient and the input of the second skin temperature target for a second patient. The actual sensed temperature value may be the average of the first actual temperature sensed by the first temperature sensor and the second actual temperature sensed by the second temperature sensor.

A first input skin temperature deviation limit and a second input skin temperature deviation limit received by the control device may be used by the control device to generate an alarm signal or reject the input first skin temperature target input for the first patient and/or reject the input of the second skin temperature target for the second patient if the control temperature does not overlap both the range of the first input skin temperature deviation limit from the first input skin temperature and the second input skin temperature deviation limit from the second input skin temperature.

A display may be provided for displaying one or more of the first input skin temperature deviation limit, second input skin temperature deviation limit, the first input skin temperature and the second input skin temperature. A graphical interface or other interface using the display may provide the information in one or more of various formats.

The control device may generate an alarm signal when a first actual temperature sensed by the first temperature sensor deviates from the first input skin temperature by more than the first input skin temperature deviation limit or when the second actual temperature sensed by the second temperature sensor deviates from the second input skin temperature by more than the second input skin temperature deviation limit.

According to another aspect of the invention a method is provided for controlling the heating and temperature monitoring of infant incubators and infant warmers, the method including providing an infant space, providing a heater for heating the space, connecting a first temperature sensor to a first patient and placing the patient in the infant space and connecting a second temperature sensor to a second patient and placing the second patient in the infant space. A monitoring and control unit is connected to the first temperature sensor and is connected to the second temperature sensor. An input device is associated with the monitoring and control unit. The input device is used to set a skin temperature target setting for the first patient. The input device is used to set a skin temperature target setting for the second patient. A control temperature is formed from the input first skin temperature target setting and the input second skin temperature target setting. The process heats the space based on a difference between the control temperature and an actual temperature value that is a function of a first actual temperature sensed by the first temperature sensor and a second actual temperature sensed by the second temperature sensor.

According to still another aspect of the invention, an infant heat treatment system is provided with an infant support surface a heating unit a plurality of skin temperature sensors and a monitoring and control unit for controlling the operation of the heating unit to heat the infant on the surface and for receiving input settings including at least a first and second skin temperature setting and allowable deviation settings. The monitoring and control unit is operable in a single patient mode for controlling the heating unit based on a relationship between a temperature signal from at least one of said plurality of skin temperature sensors and at least one skin temperature setting for a single patient on the infant support surface. The monitoring and control unit is also operable in a twin patient mode for controlling the heating unit based on at least a relationship between a temperature signal from a first skin temperature sensor connected to a first infant on the infant support surface and a temperature signal from a second skin temperature sensor connected to a second infant on the infant support surface and a first skin temperature setting based for the first infant and a second skin temperature setting for the second infant where the temperature control setting overlaps a range defined by each of a first skin temperature setting plus or minus a first patient skin temperature deviation setting and defined by a second skin temperature setting plus or minus a second patient skin temperature deviation setting.

In such a twin mode the user can set multiple skin temperatures. In the case of twins two skin temperature targets, $T_{skin1}$ set and $T_{skin2}$ set, one for each infant, and two skin deviation alarm limits $T_{da1}$ and $T_{da2}$ (±0.3 to 1.0) are set. The monitoring and control unit algorithm will calculate a control temperature using both skin temperature entries as follows:

$$T_{control}=(T_{skin1}+T_{skin2})/2 \tag{1.0}$$

As a condition for the algorithm to accept the entries of $T_{skin1}$ and $T_{skin2}$ the correlation skin deviation alarm limits must have a range with an overlap, which defines the range of the control temperature $T_{control}$. This condition may be expressed as follows:

$$\text{For example } T_{skin1}<T_{skin2} \tag{2.0}$$

$$T_{skin1}+T_{da1}>T_{control}>T_{skin2}-T_{da2} \tag{2.1}$$

The control temperature range $T_{\Delta control}$ may then vary but within the range defined by the set skin temperatures $T_{skin1}$ set and $T_{skin2}$ set and the two skin deviation alarm limits $T_{da1}$ and $T_{da2}$:

$$T_{skin2}-T_{da2}\leqq T_{\Delta control}\leqq T_{skin1}+T_{da1} \tag{2.2}$$

The twin mode differs from skin temperature control based on $T_{control}$ as described in (1.0) above, being based on skin temperature information from two or more infant patients as opposed to the use of one or more skin temperature settings. This $T_{control}$ can vary with a temperature range defined by (2.2) without causing any deviation alarm. A deviation alarm will be generated or the setting will be rejected if either $T_{skin1}$ set and/or $T_{skin2}$ set are outside the control temperature range $T_{\Delta control}$. The procedure is similar for triplets, quadruplets etc., wherein skin temperature targets, one for each infant, and skin deviation alarm limits are set. The $T_{control}$ is determined based on the skin temperature information for each of the infants.

Infant care devices which include a lying surface or surface to support the infant and which provide heat to the infant are broadly the concern of the invention. This includes incubators, infant warmers as well as hybrid device which provide both an enclosed incubator space as well as the ability to open up the structure to provide an open infant warmer. The infant care unit may also be a transport incubator, both for in-house and as for use as a complete self-contained mini NICU (with monitoring, ventilator, iv pumps, etc.) used in fixed wing airplanes, helicopters and ambulances. This has similar features to standard incubators/warmers.

The heating device or heating unit may be a single unit or may be multiple units working in concert. The unit may be an air warmer by itself or an air warmer with a humidifier for regulating the moisture content in an incubator or warmer space. In incubators these air warmers typically distribute air at the side edges of the incubator thereby heating the incubator structure itself for better heat transferred to in the infant patient. Additionally the mattress may provide the heat to the infant by contact between the infant and the mattress, thereby providing conductive heat transfer. The air heating unit may include a single heating structure or multiple heating structures and may provide plural outlets as disclosed in U.S. Pat. No. 5,944,651 or directed warm air provided for different purposes. Reference is made to U.S. Pat. No. 5,944,651 which is hereby incorporated by reference. Further the incubator structure may be a multiple walled structure wherein the wall inside is warmer than the outside wall. The heating unit may also include a radiant heating unit for providing heat to the infant patient by radiation. This is typically provided with infant warmers wherein the infant warmer has sidewalls but is open to the top for operation with a radiant heater.

The invention provides a system method and apparatus wherein the caregiver provides an input of at least a skin temperature in single infant mode and skin temperatures for each of two or more infants in twin mode (i.e., for twin infants, triplets, quadruplets, etc.) Additionally at least one deviation alarm temperature limit for the skin temperature of one infant patient is provided for single use mode whereas two skin deviation alarm limits are provided for twin mode use. The invention provides for a formulation of a temperature control based on the two skin temperature settings. The particular actual algorithm used for changing the heat provided by the heating unit may be of various different types as is generally known and as is described herein. Advantageously the control system uses the set parameters in twin mode and deviation limits in a similar manner as in single mode but based on the temperature control formed from the settings of two or more infant patients. Such a control system may be a Proportional Integral Differential (PID) control system. A control of the heating unit for temperature control from U.S. Pat. No. 5,385,529 may be used. U.S. Pat. No. 5,385,529 is hereby incorporated by reference.

Various modes of operation are discussed herein with reference to the invention wherein particularly the invention provides both a twin mode and some other single mode or other single modes. These additional modes can include air mode, skin mode and other modes as mentioned above and also kangaroo mode, a mode wherein the parent of a single child using the infant care device holds the child preferably while the childs temperature is monitored. For Kangaroo mode the setting of the incubator or child warmer is changed to for example air mode such that the childs temperature no longer is used to control the settings of the incubator or child warmer space. Further, the invention provides a twin kangaroo mode wherein one of the twins may be removed from the incubator or child warmer space and may be monitored in kangaroo mode whereas the settings for the incubator itself are switched over to single mode based on the setting for the child still remaining in the incubator and based on the temperature sensed relating to the incubator space and the skin temperature of the child still remaining in the incubator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
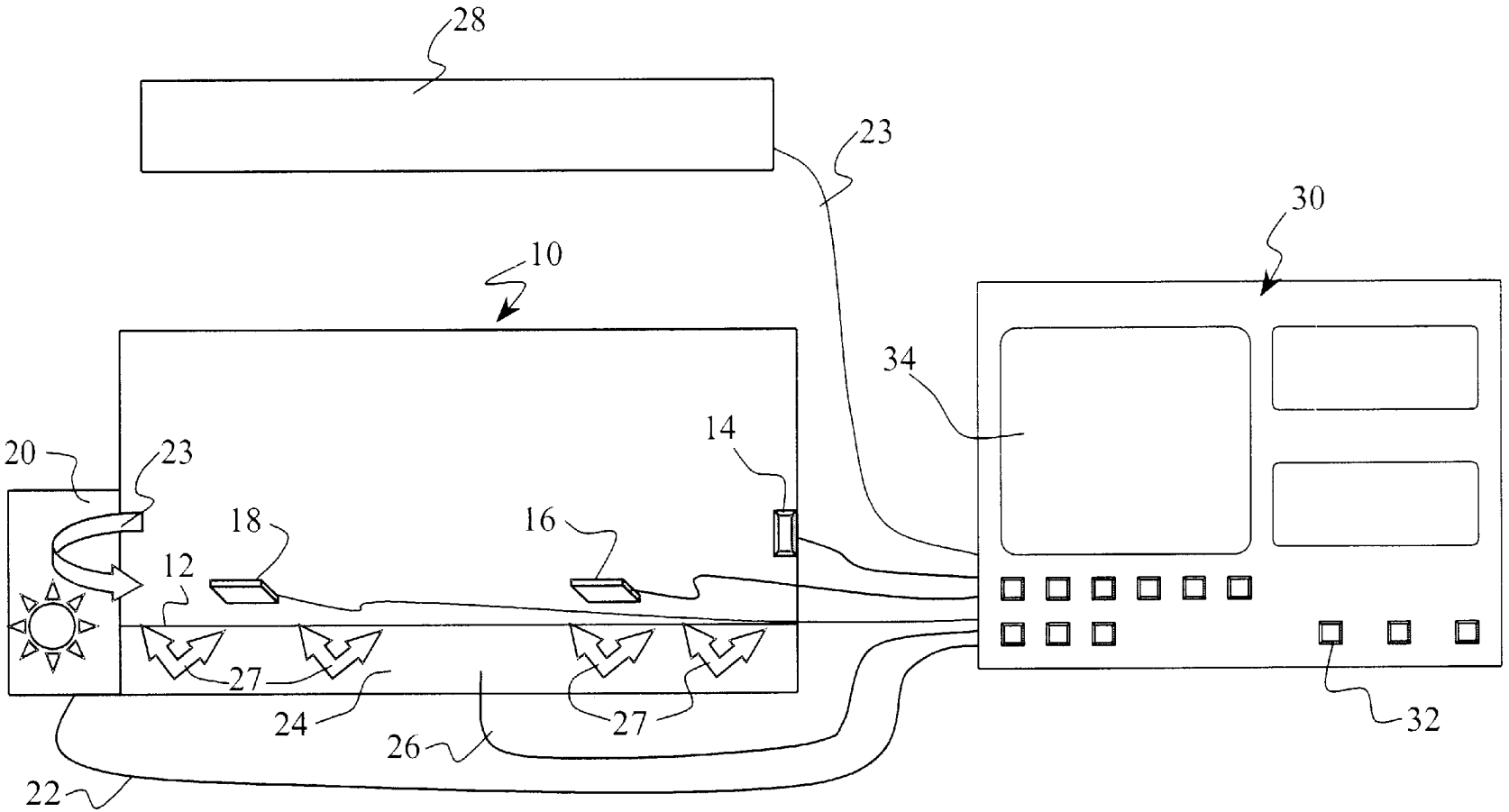
FIG. 1 is a schematic view of the system and arrangement according to an embodiment of the invention.

Referring to the drawings in particular, the invention comprises a system for controlling the heating and temperature monitoring of an infant space 8 of an infant incubators or infant warmers (infant care units) 10. Such an infant care unit has at least a lying surface or support surface 12. When the infant care unit 10 is an infant warmer it at least has side walls. Where the infant care unit 10 is an incubator both side walls and a top wall are provided. A hybrid incubator/infant warmer may also be provided as the infant care unit 10 wherein the top may be removed or put in an inoperative position, out of the way, thereby converting the infant care unit 10 between an incubator and an infant warmer.

The system and device includes a heater such as an air heater 20. As is generally known the heater 20 includes a heating elements and fan. It is also possible to provide a humidification unit for regulating the moisture content in air circulated to the infant care unit 10. FIG. 1 schematically shows the convective heat transfer 23 wherein the air that is recirculated by the heater 20 may add warmth and/or moisture to the air being circulated. The infant care unit may also include a mattress 24 forming the lying surface 12. The mattress may be a mattress heater 24 which provides conductive heat transfer between the mattress surface and an infant lying on the lying surface 12. The heating unit or heater may also be a radiant heater 28 positioned above the infant care unit 10. Such radiant heaters 28 are typically used with infant warmers wherein there is no top or lid to the infant care unit 10. The system of the invention also includes an air temperature sensor 14 for measuring the air temperature of the infant space. The invention is practiced with preferably with at least a first skin sensor 16 and a second skin sensor 18. It is noted that the skin sensors 16 and 18 can also be dual sensors, namely measuring a skin temperature of an infant patient at one side of the sensor and measuring the air temperature at the other side. Further other types of temperature sensors may be provided such that the invention may be practiced with various types of sensors and in various numbers.

The system of the invention includes a monitoring and control unit 30. The monitoring and control unit preferably includes at least a processor or control logic means for receiving inputs including setting input and actual sensed values and for following an algorithm for adjusting the heat supplied by one or more of heaters 20, 24 and 28. The monitoring and control unit 30 preferably also includes an input 32 and a display 34. The input 32 may be fixed buttons associated with fixed functions or may be fixed buttons associated with changeable functions or even soft keys associated with the display 34. Soft keys may provide functions wherein the function is displayed and the display can change providing different functions in different situations. The fixed input keys 32 may also have a function which changes depending upon the display provided. Of course the input may be an attached keyboard, a mouse or even a bar code reader or other known arrangements for providing input data to the system. The monitoring and control unit 30 may be of a multi part design with one or more displays 34 and input devices 32.

The system and method of the invention based on the structure shown in FIG. 1 or variation thereof as is generally known in the art. The system and method provide monitoring of an individual patient in infant space 8 or monitoring of two or possibly more patients in infant space 8. Additionally, the invention provides for a control mode which takes into account setting for two different infant patients in infant space 8 which produce a common control for this space based on preferences for the two different infants.

Figure 2:
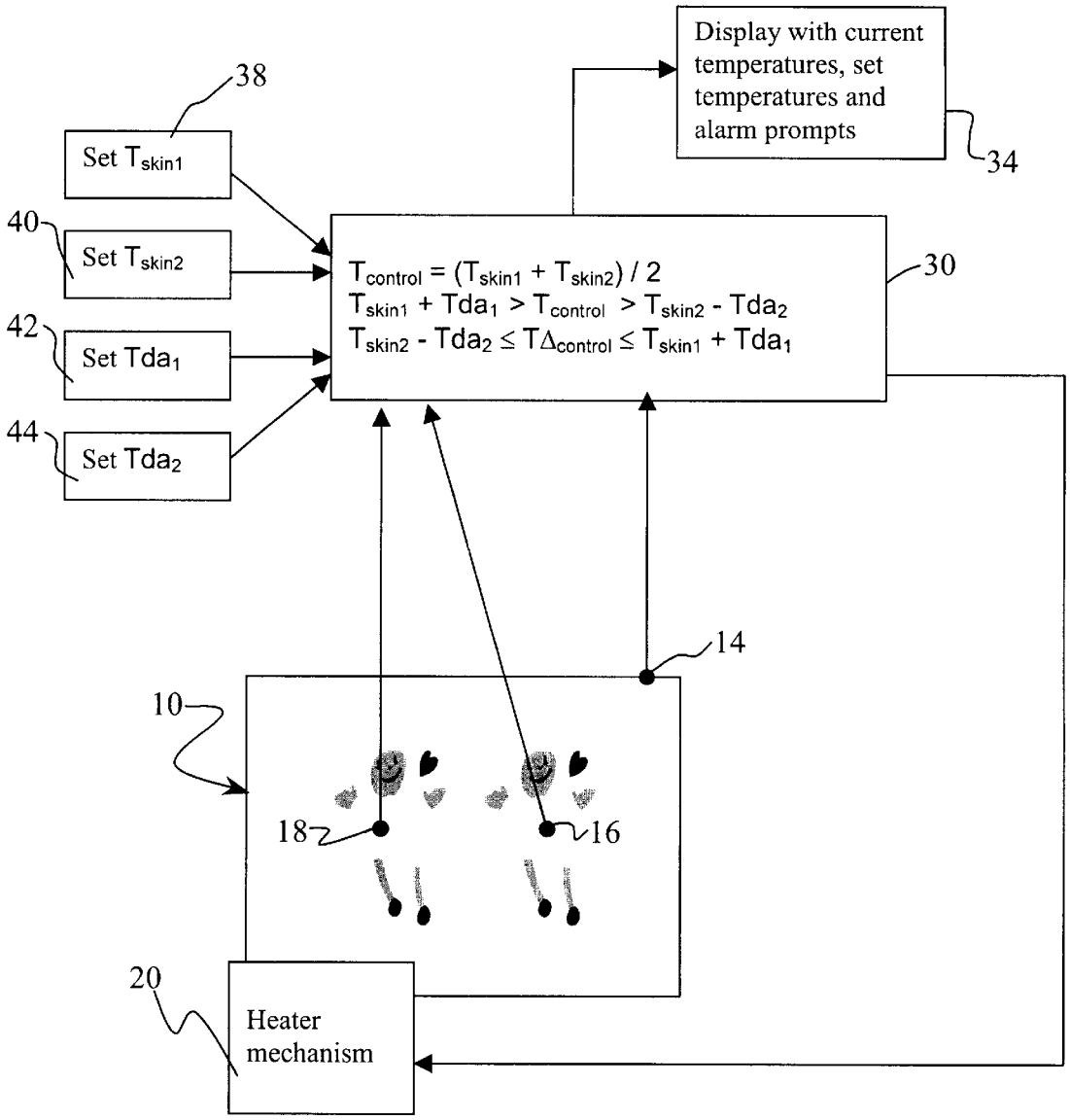
FIG. 2 is a schematic diagram showing system features according to an embodiment of the invention.

As shown in FIG. 2, desired skin temperature input 38 for a first patient is entered into the monitoring and control unit 30. The desired or set skin temperature for the second patient is provided as an input 40 into the monitoring and control unit 30. Further a first patient deviation alarm value 42 is provided as an input into the monitoring and control unit 30 and a second patient deviation alarm value 44 is provided as an input into the monitoring and control unit 30. According to the method of the invention and the system of the invention the monitoring and control unit 30 form a common control value or $T_{control}$ which is the average of the two skin temperature set values for the two different infant patients. It is also possible to form a different common control value $T_{control}$ which is a function of the two set skin temperatures but is not equally weighted for each patient. However an equal weighting of the skin temperature settings to form the $T_{control}$ is advantageous wherein the operation of the heating unit may be based on an algorithm which considers $T_{control}$ and provides some weighting toward the requirements of one or the other of the two or more patients. After forming the $T_{control}$ value the system and method of the invention the monitoring and control unit 30 determines whether the generated $T_{control}$ value is within the setting range for the first patient. This first patient range is from the set temperature for the first patient minus the deviation alarm value temperature to the set temperature for the first patient plus the deviation alarm value. The determined $T_{control}$ value must also be within the setting range of the second infant patient, namely from the set temperature from the second patient minus the deviation value to the temperature set for the patient plus the deviation value. Where the temperature control is not within these two ranges the system and method of the invention preferably generates an alarm or rejects the attempted settings. Particularly, in such a situation co-bedding is not a practical option as one of the two infants will not be properly within the desired range. The system and method of the invention also provides that the monitoring and control unit checks the change in temperature control which is allowed according to the settings entered. Of course if this range is 0 (no overlap) the proposed setting have already been rejected. However, the display of such a range of temperature control can be useful information for the caregiver and the change in temperature control must satisfy the inequality/equation 22 (shown at the bottom of the monitoring and control unit 30 of FIG. 2). FIG. 2 shows the inequalities/equations 2.1 and 2.2 are based on the setting for infant one being lower than the setting for infant two (inequality 2.0). Obviously if these are reversed (one setting is always higher than the other or the settings are the same) than the indicated values for patent one would be switched with the values for patient two.

The method and system of the invention provide for an entry of settings for a twin care mode and then further regulation of the heating unit based on these settings. During this process, where one of the actual temperatures of a patient goes outside of the range, an appropriate alarm or alarm prompt may be provided. Further the method and system of the invention allows for a change of mode to for example air control, skin control or single patient central skin and peripheral skin control. Further the system can be shifted over to twin mode which can include any and all of skin control twin mode, skin control twin mode with central and peripheral temperature sensing as well as twin kangaroo mode (the sensor to one infant provides monitoring and the sensor for the other infant operates the unit in skin control mode or central skin and peripheral skin control mode). Other modes are also possible.

Figure 3:
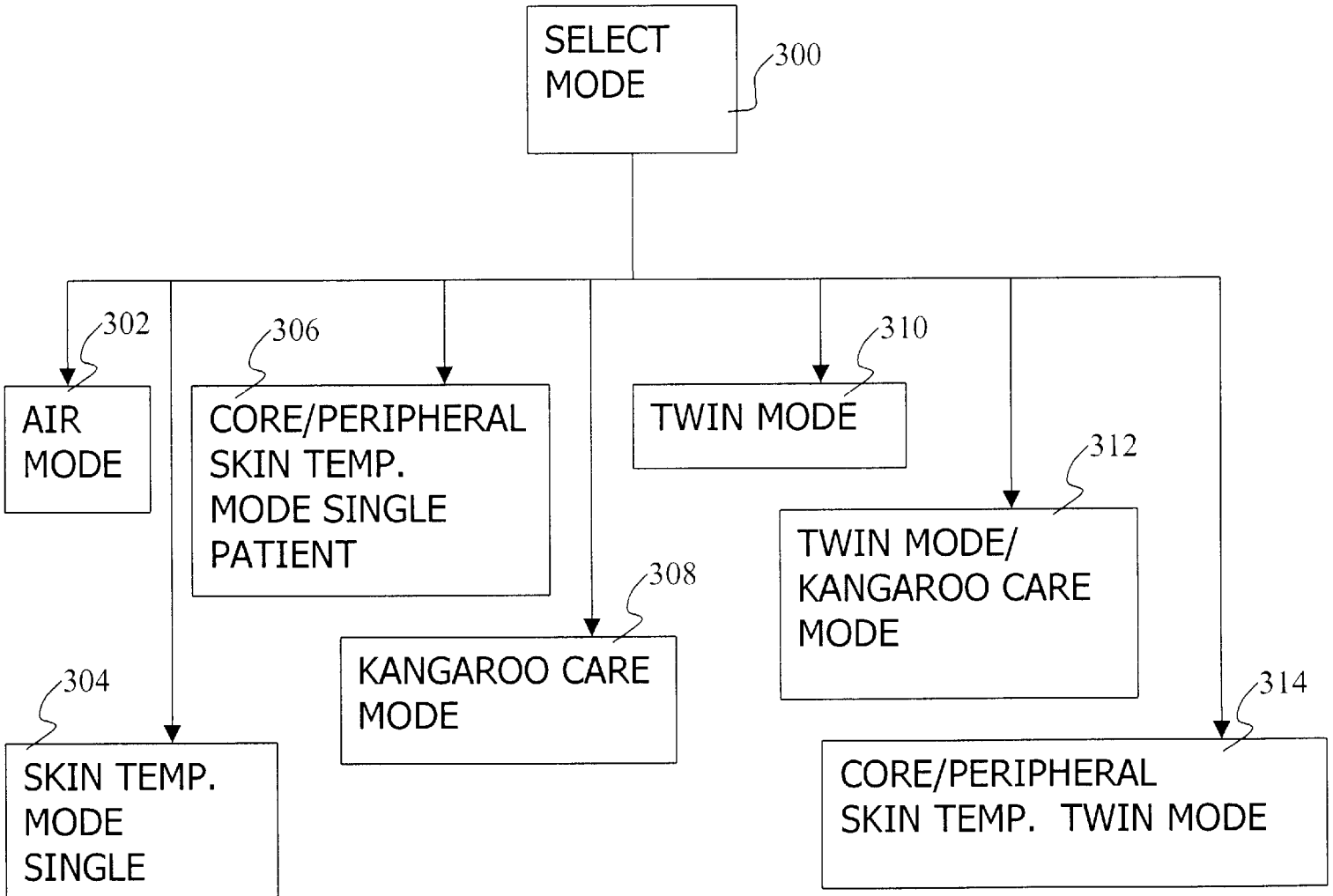
FIG. 3 is a diagram showing a selection of various different operation modes for the infant care unit.

FIG. 3 is a flow diagram showing the selection step according to the process of the invention. At number 300 the caregiver selects the mode which the infant care unit 10 is to provide. Examples of possible modes which can be provided at the selection step include the air mode 302 as described above, the single patient skin mode 304 as described above, the single patient core/peripheral skin mode 306 as described above and the kangaroo mode 308 as described above. A particular mode of kangaroo care may be as disclosed in U.S. application Ser. No. 09/639,721, now U.S. Pat. No. 6,443,885, which is hereby incorporated by reference (see also DE 199 60 989). Further according to the process of the invention at least one twin mode 310 is provided. This is as described above and is further described below. Additionally a twin kangaroo mode can be provided. This twin kangaroo mode is indicated at 312. Further the more elaborate twin modes can be provided for example based on the sensing of the core of the patient (skin temperature sense of the abdomen, back or forehead-head) and a peripheral skin sensor at the foot or hand. With the twin core/peripheral mode a single temperature control value $T_{control}$ is formed as a function of the two skin temperatures sensed from each of the first infant patient and the second infant patient number two.

Figure 4A:
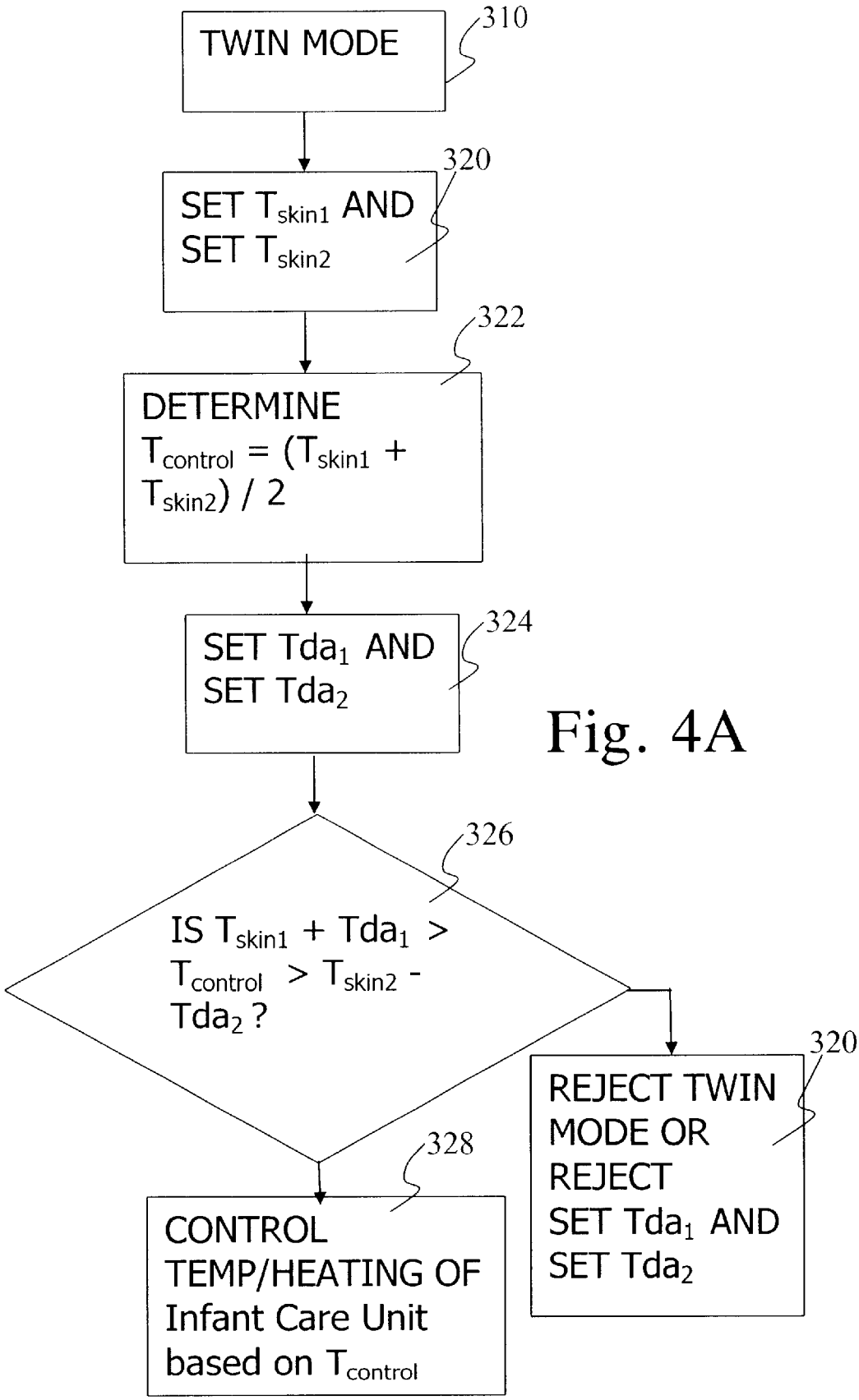
FIG. 4A is a flow diagram showing basic process steps for initiating twin mode monitoring and control of the infant care unit.

FIG. 4A shows the basic process steps for initiating twin mode. As shown at step 310 twin mode is selected. The caregiver then sets the desired skin temperature for each of the two patients as indicated at 320. The monitoring and control unit then calculates a temperature control value $T_{control}$ as shown at 322. The caregiver also enters the deviation alarm settings $T_{da1}$ and $T_{da2}$ for the temperature of patient one and two as shown at 324. The order of these steps is not critical as all values may be entered before any calculation takes place as to the $T_{control}$ value at 322. The monitoring and control unit checks at step 326 to determine if the $T_{control}$ value calculated is in the range of settings of each of the patients. Obviously if there is no overlap in the settings for the patient (the range based on the deviation from the temperature set, co-bedding cannot be provided). When this occurs the settings for the deviation or the settings for the temperature are rejected and twin mode is not available. If the $T_{control}$ value is within the range of settings of each of the patients the system controls the infant care unit 10 by heating the infant care unit based on the $T_{control}$ setting which is formed from the settings for each of the two patients as indicated at 328.

Figure 4B:
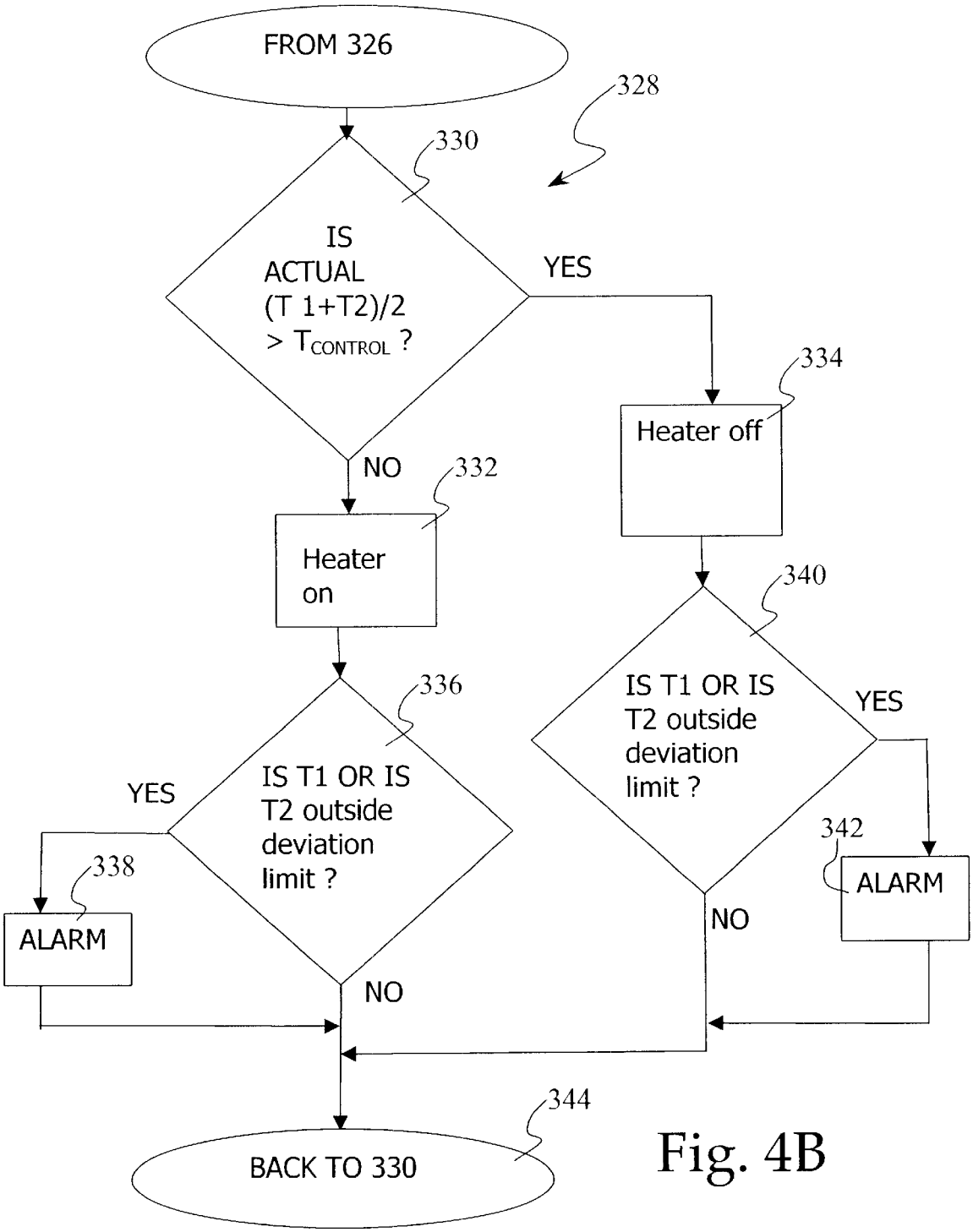
FIG. 4B is a flow diagram showing basic process steps of one example for heat control of the infant care unit in twin mode.

FIG. 4B shows basic process steps for heater control and alarms for twin mode. This is a simple example based on comparing at 330 the actual average of the temperature of infant patient one (T1) and infant patient two (T2) to $T_{control}$. The actual algorithm for heating control 328 may include a PID control and may include various additional control considerations. As shown at step 332, if the result is NO, the heater is switched on as shown at 332. If the result of step 330 is YES, the heater is switched off at step 334. Proceeding from step 332, the heat control algorithm 328 checks at step 336 to determine if either the actual temperature T1 of patient one or the actual temperature T2 of patient two is outside the deviation limits ($T_{da1}$ and $T_{da2}$ respectively). If either temperature has exceeded the limit the alarm is provided as indicated at step 338. If both temperatures are within the respective deviation limits no alarm is provided. The control algorithm 328 further proceeds back to step 330 as indicated at step 344. Where the heater is maintained off or is switched off as indicated step 334 the control algorithm 328 still considers whether either the actual temperature T1 of patient one or the actual temperature T2 of patient two is outside the deviation limits ($T_{da1}$ and $T_{da2}$ respectively). If the result is yes, the alarm is provided as indicated step 342. In both cases the control process proceeds back to step 330 as indicated at step 344.

Figures 5, 6:
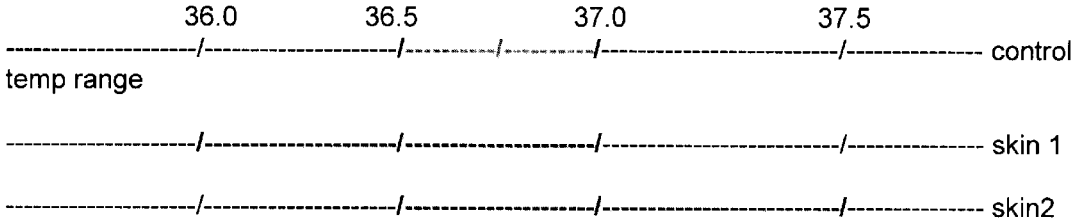
FIG. 5 is a graph showing the range of the first patient temperature settings and second temperature settings and the effect on the temperature control range according to the twin mode operation of the invention.
FIG. 6 is a view showing a possible display with a display of set values and a display of actual sensed values.

An example of the twin mode is illustrated in FIG. 5. In this example skin I ($T_{skin1}$) is set to 36.5° C. and skin2 ($T_{skin2}$) is set to 37.0° C. both with +/−0.5° C. deviation (i.e., $T_{da1}$=$T_{da2}$=0.5° C.). That results in a control range $T_{\Delta control}$ of 36.5° C. to 37.0° C. for the incubator to control with a $T_{control}$ start point of 36.75° C.

The alarms would occur as follows:

low priority: If one skin temperature runs out of the control range, e.g. skin1 above 37.0.

high priority: If both skin temperatures are out of range.

The system can be configured to various degrees of flexibility. The user can adjust the "flexibility" of the system by entering in larger or smaller deviations $T_{da1}$ and $T_{da2}$.

The text display of the incubator warmer may display a prompt in case of deviation alarm to e.g. increase the deviation of $T_{da1}$ and/or $T_{da2}$ to allow a wider control range. The display and interface may provide intelligent feedback.

In any case this flexible balanced system can control both infants temperature within the given ranges as long as the main condition is met $$\text{For example where } T_{skin1} 21\ T_{skin2} \tag{2.0}$$

$$T_{skin1}+T_{da1}>T_{control}>T_{skin2}-T_{da2} \tag{2.1}$$

$$T_{skin2}-T_{da2}\leqq T_{\Delta control}\leqq T_{skin1}+T_{da1} \tag{2.2}$$

and the infants are reasonably stabile.

The same result can be achieved when the incubator is run in air mode with twin infant patients. However, the accuracy of the control depends on the caregiver's skills and the frequency of measuring the infant's temperatures and the frequency of adjusting the air temperature setting.

Both infants may never be at their perfect temperature, but in twin MODE, both temperature requirements are balanced within a defined range and continuously controlled with safeguards equivalent to the preferred skin mode for single infants. The user can even set preferences, by entering in a larger deviation for the more stabile infant, and a smaller deviation for the less stabile infant. Default settings may be provided for $T_{da1}$ and/or $T_{da2}$ of 1.0° C.

The display 34 may be of various formats including multiple screens or a single screen that may change depending upon the situation. A display 34 is shown in FIG. 6 with a possible display content. The shown content includes the various settings for twin mode and the sensed data reported back from the incubator. Since the incubator/warmer is operating in an allowed set range rather that towards one specific set point the displayed information is advantageously grouped as follows:

All input values $T_{skin1}$ with deviation $T_{da1}$ and $T_{skin2}$ with $T_{da2}$ Current temperatures $T_{skin1}$ and $T_{skin1}$ Control temperature range $T_{\Delta control}$ The display should allow the information to be presented as numerical values or in a diagram similar to what is shown in FIG. 5. The input scheme may be user-friendly such as to walk to the caregiver through all the required steps to establish the twin mode operation. Such a display and user interface can suggest defaults (default settings) for each required setting, e.g., 36.5 deg. C. for the T1 and T2 settings and 1.0 deg. C. for the deviations. The user has then the chance to alter these or to accept them as they are. The input devices can be rotary knobs to adjust settings and then push the rotary knob to confirm the input. The interface can be a graphical interface with a mouse or other simple input device with sequences of menus for the input values. Advantageously come up to the user can select the interface from one of several graphical user interfaces or other heat user interfaces. The interface may provide a simple graphical information (including for example a green light indicating that the mode is functioning properly or yellow light to indicate attention is required or a red light to indicate that the system is not operating correctly). Bar graphs come up high cramps and other graphical presentations may also preferably be selected. At the other extreme the interface may display raw data and settings providing the caregiver with information to take the appropriate action.

The infant care unit 10 may also include integrated infant scales. The monitoring and control unit 30 or another control unit may keep track of the weights for both infants separately. This may be a further feature of twinMODE operation. This functions as follows: Push weight button: Scale prompts to lift the infant 1 off the mattress to zero the scale. Scale gives an acoustical signal (beep) and prompts the user to replace the infant on the mattress. Scale measures weight and subtracts the zero weight and displays the infant 1's weight. After that the value is stored and can be displayed as the weight trend for infant 1. Then the scale prompts to same procedure for infant 2. The monitoring and control unit 30 may provide such trending information for weight, temperature and various other monitored parameters such as temperature, humidity and oxygen measurements and settings. All twinMODE data may also be available in a trend format.

While specific embodiments of the invention have been shown and described in detail to illustrate the application of the principles of the invention, it will be understood that the invention may be embodied otherwise without departing from such principles.

What is claimed is:

1. A system for controlling the heating and temperature monitoring of infant incubators and infant warmers, comprising:

structure defining an incubator or infant warmer space;

a heater for heating the space;

a first temperature sensor;

a second temperature sensor;

an input device for input of one or more control settings; and a control device connected to the heater and to the first temperature sensor and the second temperature sensor and forming a control temperature from an input first skin temperature target control setting for a first patient and an input of a second skin temperature target control setting for a second patient and controlling the heater based on a difference between the control temperature and an actual temperature value based on a first actual temperature sensed by the first temperature sensor and a second actual temperature sensed by the second temperature sensor.

2. A system according to claim 1, wherein the control device calculates the control temperature as the average of the input first skin temperature target for the first patient and the input of the second skin temperature target for a second patient.

3. A system according to claim 1, wherein the actual temperature value is the average of the first actual temperature sensed by the first temperature sensor and the second actual temperature sensed by the second temperature sensor.

4. A system according to claim 1, further comprising a first input skin temperature deviation limit and a second input skin temperature deviation limit received by the control device, the control device generating an alarm signal or rejecting the input first skin temperature target input for the first patient and/or rejecting the input of the second skin temperature target for the second patient where the control temperature does not overlap both the range of the first input skin temperature deviation limit from the first input skin temperature and the second input skin temperature deviation limit from the from the second input skin temperature.

5. A system according to claim 4, further comprising a display for displaying one or more of the first input skin temperature deviation limit, second input skin temperature deviation limit, the first input skin temperature and the second input skin temperature.

6. A system according to claim 1, wherein the control device generates an alarm signal when a first actual temperature sensed by the first temperature sensor deviates from the first input skin temperature by more than the first input skin temperature deviation limit or when the second actual temperature sensed by the second temperature sensor deviates from the second input skin temperature by more than the second input skin temperature deviation limit.

7. A system according to claim 1, wherein the heater comprises a radiant heater.

8. A system according to claim 1, wherein the heater comprises an air heater.

9. A system according to claim 1, wherein the heater comprises a mattress heater for conductive heat transfer.

10. A method for controlling the heating and temperature monitoring of Infant incubators and infant warmers, the method comprising the steps of:

providing an infant space;

providing a heater for heating the space;

connecting a first temperature sensor to a first patient and placing the patient in the infant space;

connecting a second temperature sensor to a second patient and placing the second patient in the infant space;

providing a monitoring and control unit connected to the first temperature sensor and connected to the second temperature sensor;

providing an input device associated with the monitoring and control unit;

using the input device to set a skin temperature target setting for the first patient;

using the input device to set a skin temperature target setting for the second patient;

forming a control temperature from the input first skin temperature target setting and the input second skin temperature target setting;

heating the space based on a difference between the control temperature and an actual temperature value that is a function of a first actual temperature sensed by the first temperature sensor and a second actual temperature sensed by the second temperature sensor.

11. A method according to claim 10, wherein the control device calculates the control temperature as the average of the input first skin temperature target for the first patient and the input of the second skin temperature target for a second patient.

12. A method according to claim 10, further comprising using an input device to set a first input skin temperature deviation limit and a second input skin temperature deviation limit at the control device and determining if the control temperature formed overlaps both the range of the first input skin temperature deviation limit from the first input skin temperature and the second input skin temperature deviation limit from the from the second input skin temperature.

13. A method according to claim 12, further comprising providing a display for displaying one or more of the first input skin temperature deviation limit, second input skin temperature deviation limit, the first input skin temperature and the second input skin temperature.

14. A method according to claim 10, wherein the control device generates an alarm signal when a first actual temperature sensed by the first temperature sensor deviates from the first input skin temperature by more than the first input skin temperature deviation limit or when the second actual temperature sensed by the second temperature sensor deviates from the second input skin temperature by more than the second input skin temperature deviation limit.

15. A method according to claim 10, further comprising the steps of disconnecting the second temperature sensor from the second patient and removing the second patient from the infant space;

connecting a further location sensor, provided as one of the second temperature sensor or another temperature sensor, to another location of the first patient in the infant space;

heating the space based on one or both of the first actual temperature sensed by the first temperature sensor and the second actual temperature sensed by the further location sensor.

16. A method according to claim 10, further comprising the steps of:

disconnecting the first temperature sensor from the first patient and removing the first patient from the infant space;

disconnecting the second temperature sensor from the second patient and removing the second patient from the infant space;

connecting the first temperature sensor to a central location of another patient and placing the another patient in the infant space;

connecting the second temperature sensor to a peripheral location of the another patient in the infant space;

heating the space based on one or both of the first actual temperature sensed by the first temperature sensor and the second actual temperature sensed by the second temperature sensor.

17. An infant heat treatment system, comprising:

an infant support surface;

a heating unit;

a plurality of skin temperature sensors;

a monitoring and control unit for controlling the operation of the heating unit to heat the infant on the surface and for receiving input settings including at least a first and second skin temperature setting and allowable deviation settings, the monitoring and control unit being operable in:

a single patient mode for controlling the heating unit based on a relationship between a temperature signal from at least one of said plurality of skin temperature sensors and at least one skin temperature setting for a single patient on the infant support surface and a twin patient mode for controlling the heating unit based on at least a relationship between a temperature signal from a first skin temperature sensor connected to a first infant on the infant support surface and a temperature signal from a second skin temperature sensor connected to a second infant on the infant support surface and a first skin temperature setting based for the first infant and a second skin temperature setting for the second infant where the temperature control setting overlaps a range defined by each of a first skin temperature setting plus or minus a first patient skin temperature deviation setting and defined by a second skin temperature setting plus or minus a second patient skin temperature deviation setting.

18. A system according to claim 17, wherein the infant support surface is part of an incubator with walls at least partially enclosing the infant support surface.

19. A system according to claim 17, wherein the infant support surface is part of an infant warmer with side walls at least partially around the infant support surface.

* * * * *